US005477992A

United States Patent [19]

Jinks et al.

[11] Patent Number: 5,477,992

[45] Date of Patent: Dec. 26, 1995

[54] METERED-DOSE AEROSOL VALVES

[75] Inventors: Philip A. Jinks, Mountsorrel, England; Charles G. Thiel, St. Paul, Minn.; Trevor J. Wilde, Burnely, England

[73] Assignee: Minnesota Mining and Manufacturing Company, St. Paul, Minn.

[21] Appl. No.: 216,644

[22] Filed: Mar. 23, 1994

[30] Foreign Application Priority Data

Mar. 23, 1993 [GB] United Kingdom ..... 9305975

[51] Int. Cl.[6] ..... B65D 83/14

[52] U.S. Cl. ..... 222/402.2; 222/449; 222/635; 239/573

[58] Field of Search ..... 222/207, 402.1, 222/402.2, 449, 635; 239/573

[56] References Cited

U.S. PATENT DOCUMENTS

| | | | |
|---|---|---|---|
| 2,886,217 | 5/1959 | Thiel | 222/394 |
| 3,727,806 | 4/1973 | Wilmot | 222/402.2 |
| 4,407,481 | 10/1983 | Bolton et al. | 222/402.2 X |
| 4,433,797 | 2/1984 | Galia | 222/207 |
| 4,863,073 | 9/1989 | Burt et al. | 222/402.2 |
| 4,867,352 | 9/1989 | Meshberg | 222/402.2 X |
| 5,037,012 | 8/1991 | Langford | 222/402.2 |
| 5,337,929 | 8/1994 | van der Heijden | 222/635 X |

FOREIGN PATENT DOCUMENTS

| | | |
|---|---|---|
| 2147177 | 3/1973 | France . |
| 1700092 | 1/1970 | Germany . |
| 872187 | 7/1959 | United Kingdom . |
| 848997 | 9/1960 | United Kingdom . |
| 848998 | 9/1960 | United Kingdom . |
| 852804 | 11/1960 | United Kingdom . |
| 864391 | 4/1961 | United Kingdom . |
| 864392 | 4/1961 | United Kingdom . |
| 864694 | 4/1961 | United Kingdom . |
| 877828 | 9/1961 | United Kingdom . |
| 877933 | 9/1961 | United Kingdom . |
| 878409 | 9/1961 | United Kingdom . |
| 892166 | 3/1962 | United Kingdom . |
| 897461 | 5/1962 | United Kingdom . |
| 1201918 | 8/1970 | United Kingdom . |
| 1201919 | 8/1970 | United Kingdom . |
| 1287126 | 8/1972 | United Kingdom . |
| 1336379 | 11/1973 | United Kingdom . |
| 2049064 | 2/1983 | United Kingdom . |
| 2178398 | 2/1987 | United Kingdom . |
| 2195986 | 2/1990 | United Kingdom . |
| WO92/11190 | 7/1982 | WIPO . |

OTHER PUBLICATIONS

European Search Report dated Jun. 15, 1994 for European application corresponding to this U.S. Application Ser. No. 08/216,644.

*Primary Examiner*—Andres Kashnikow
*Assistant Examiner*—Joseph A. Kaufman
*Attorney, Agent, or Firm*—Gary L. Griswold; Walter N. Kirn; Dale E. Hulse

[57] ABSTRACT

Metered dose dispensing valves providing good dosage reproducibility with formulations having a propensity to cream and with low concentration formulations. Valves having a tank retaining cup have a small inlet aperture of no more than 0.7 mm and preferably the tank retaining cup follows the configuration of the end of the valve stem. Valves having a bottle emptier attached to the valve stem have a filling channel in the valve stem which protrudes only slightly from the metering chamber when the valve is in its inoperative position.

8 Claims, 3 Drawing Sheets

METERED-DOSE AEROSOL VALVES

BACKGROUND OF THE INVENTION

1. Field of the Invention

This invention relates to metered-dose dispensing valves and in particular to valves for dispensing medicament from pressurized aerosol containers.

2. Description of the Related Art

Metering valves for use with pressurized metered dose inhalers (MDIs) need to meet certain performance criteria with regard to the sampling of the medicinal formulation, which is generally in the form of suspension of micronized drug particles in an aerosol propellant system. Specifically, the valve must sample the formulation homogeneously in order that the correct dose of medicament is delivered to the patient on each actuation of the valve. Most commercially available valves fulfill this requirement when the formulation is well dispersed.

It has been found that valve types vary considerably in their ability to dose high potency low concentration formulations. This problem is particularly significant when the formulations are not well dispersed as may occur in various conditions in the field, for instance when a formulation has been allowed to stand for a while such that creaming has taken place and the valve is actuated without shaking the product.

In such circumstances, depending on the valve design, it may be possible to deliver either a dose within intended specification or a dose of up to about twenty times the target value. This problem is of concern since it cannot be assumed that a patient will always shake an MDI product before use.

In addition, a second effect has been identified where valve design may influence the consistency of drug delivery. This effect concerns a tendency for drug particles to migrate to the metering tank of the valve during storage or transit, with a consequent elevation in the amount of drug delivered in the first shot. It has been found that elevated drug doses may be obtained due to this effect, particularly with high potency drugs for which there is a very small total quantity of active substance in the aerosol container.

A third effect has been identified which may cause erratic dosing and this concerns the ability of drug to cream out of the metering tank of valves stored in the stem down position when the valve is of a type having an axial point of product entry.

SUMMARY OF THE INVENTION

According to one embodiment of the invention there is provided a metered dose valve for dispensing a medicinal aerosol formulation from a pressurized container, comprising:

a valve ferrule having an aperture therethrough; a metering tank having walls defining an exterior, an internal metering chamber, an inlet orifice, an inlet end, and an outlet end; an elongate valve stem having a filling channel, a filling end, a discharge end, and a discharge orifice; and a tank retaining cup having a proximal end and a distal end, wherein the outlet end of the metering tank is in sealing engagement with the valve ferrule, the discharge end of the valve stem passes through the valve ferrule aperture and the outlet end of the metering tank and is in slidable sealing engagement with the valve ferrule aperture, the filling end of the valve stem passes through and is in slidable engagement with the inlet orifice of the metering tank, wherein the valve stem is movable between an inoperative position in which the filling channel of the valve stem allows open communication, via the inlet orifice, between the interior and the exterior of the metering chamber and the outlet end of the metering tank is closed, and an open position in which the inlet orifice of the metering tank is in sealing engagement with the filling end of the valve stem and the discharge orifice of the valve stem allows open communication between the interior and exterior of the metering chamber, and wherein the tank retaining cup has walls defining an aperture, is attached at its proximal end to the valve ferrule, and surrounds the metering tank forming a capillary pathway from the proximal end of the tank retaining cup to the inlet end of the metering tank, which pathway is defined by the tank retaining cup and the exterior of the metering tank, in which the aperture in the tank retaining cup has a diameter of no more than 0.70 mm, preferably about 0.5 mm.

According to a further embodiment of the invention there is provided a metered dose valve for dispensing a medicinal aerosol formulation from a pressurized container, comprising:

a valve ferrule having an aperture therethrough; a metering tank having walls defining an exterior, an internal metering chamber, an inlet orifice, an inlet end, and an outlet end; an elongate valve stem having a filling channel, a filling end, a discharge end, and a discharge orifice; and a tank retaining cup having a proximal end and a distal end, wherein the outlet end of the metering tank is in sealing engagement with the valve ferrule, the discharge end of the valve stem passes through the valve ferrule aperture and the outlet end of the metering tank and is in slidable sealing engagement with the valve ferrule aperture, the filling end of the valve stem passes through and is in slidable engagement with the inlet orifice of the metering tank, wherein the valve stem is movable between an inoperative position in which the filling channel of the valve stem allows open communication, via the inlet orifice, between the interior and the exterior of the metering chamber and the outlet end of the metering tank is closed, and an open position in which the inlet orifice of the metering tank is in sealing engagement with the filling end of the valve stem and the discharge orifice of the valve stem allows open communication between the interior and exterior of the metering chamber, and wherein the tank retaining cup has walls defining an aperture, is attached at its proximal end to the valve ferrule, and surrounds the metering tank forming a capillary pathway from the proximal end of the tank retaining cup to the inlet end of the metering tank, which pathway is defined by the tank retaining cup and the exterior of the metering tank, and the tank retaining cup is shaped to closely follow the configuration of the end of the valve stem within the tank retaining cup.

According to a further embodiment of the present invention there is provided a metered dose valve for dispensing a medicinal aerosol formulation from a pressurized container, comprising:

a valve ferrule having an aperture therethrough; a metering tank having walls defining an exterior, an internal metering chamber, an inlet orifice, an inlet end, and an outlet end; an elongate valve stem having a filling channel, a filling end, a discharge end, and a discharge orifice; and a bottle emptier having a proximal end and a distal end, wherein the outlet end of the metering tank is in sealing engagement with the valve ferrule, the discharge end of the valve stem passes through the valve ferrule aperture and the outlet end of the metering tank and is in slidable sealing engagement with the valve ferrule aperture, the filling end of the valve stem passes through and is in slidable engagement with the inlet orifice of the metering tank, wherein the valve stem is movable between (a) an inoperative position in which the filling channel of the valve stem does not allow open communication via the inlet orifice between the interior and the exterior of the metering chamber, (b) a filling position in which the filling channel of the valve stem allows open communication, via the inlet orifice, between the interior and the exterior of the metering chamber and the outlet end of the metering tank is closed, and (c) an open position in which the inlet orifice of the metering tank is in sealing engagement with the filling end of the valve stem and the discharge orifice of the valve stem allows open communication between the interior and exterior of the metering chamber, and wherein the bottle emptier is attached at its distal end to the filling end of the valve stem and surrounds at least the inlet end of the metering tank forming a capillary pathway from the proximal end of the bottle emptier to the inlet end of the metering tank, which pathway is defined by the bottle emptier and the exterior of the metering tank.

In another embodiment of the invention, in the inoperative position there is open communication between the interior and exterior of the metering chamber via a cross-sectional area effective to reduce or prevent axial cream out of the contents of the metering chamber.

Optionally the bottle emptier may have one of the following constructions:

1. the bottle emptier extends substantially the entire length of the metering chamber but has no flange at the open end of the capillary pathway, 2. the bottle emptier extends no more than 90% of the length of the metering chamber, 3. the bottle emptier extends the entire length of the metering chamber to prevent free flow of contents from the dispensing container to the capillary pathway when the valve stem is in its inoperative position.

It has been found that valves incorporating one or more of the above configurations provide improved dosing uniformity characteristics compared with the standard valves.

BRIEF DESCRIPTION OF THE DRAWINGS

The invention will now be described with reference to the accompanying drawings in which.

Throughout the drawings like reference numerals designate like parts.

DESCRIPTION OF THE PREFERRED EMBODIMENTS

Figure 1:
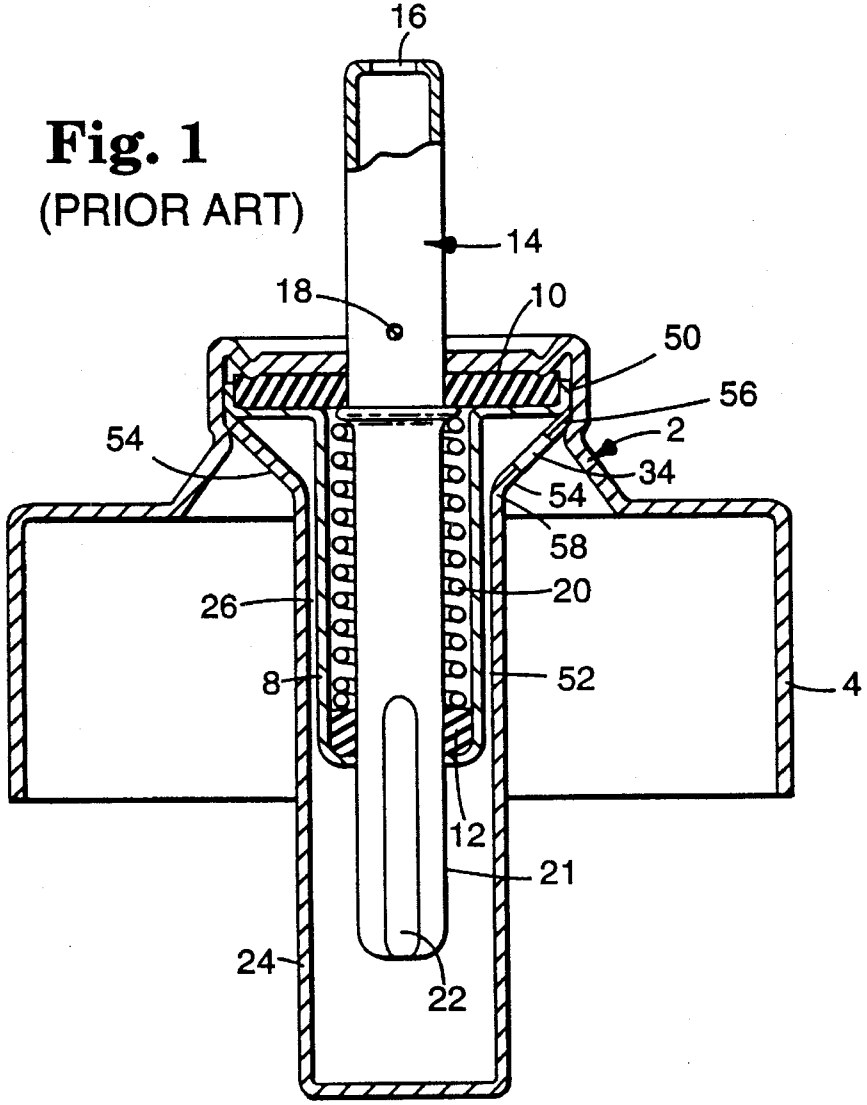
Fig. 1 (PRIOR ART)
FIG. 1 represents a longitudinal section through a known dispensing valve.

FIG. 1 represents a known valve in which the bottle emptier (24) is in the form of a tank retaining cup which is fixed relative to the metering chamber (8) and completely envelopes the metering chamber (8) and end of the valve stem (14). Communication between the capillary pathway (26) and interior of the dispensing container is afforded by aperture (34). It has been found that this valve may provide non-uniform dosing characteristics when used with low concentration dispersion aerosol formulations, for example, formulations comprising an active ingredient suspended in an aerosol propellant where the concentration of the active ingredient is not more than 1 mg/g (1 milligram of active ingredient per gram of formulation).

As seen in FIG. 1, bottle emptier (24) has a first vertical wall (50) which is more proximate to the discharge end (16) of the valve stem (14) than the filling end (21) of the valve stem (14), and a second vertical wall (52) which is more proximate to the filing end (21) of the valve stem (14) than the discharge end (16) of the valve stem (14). An inclined wall (54) joins the first vertical wall (50) to the second vertical wall (52) at a first bend (56) and second bend (58), respectively. As shown in FIG. 1, aperture (34) is located approximately the same distance from first bend (56) as from second bend (58).

Figure 2:
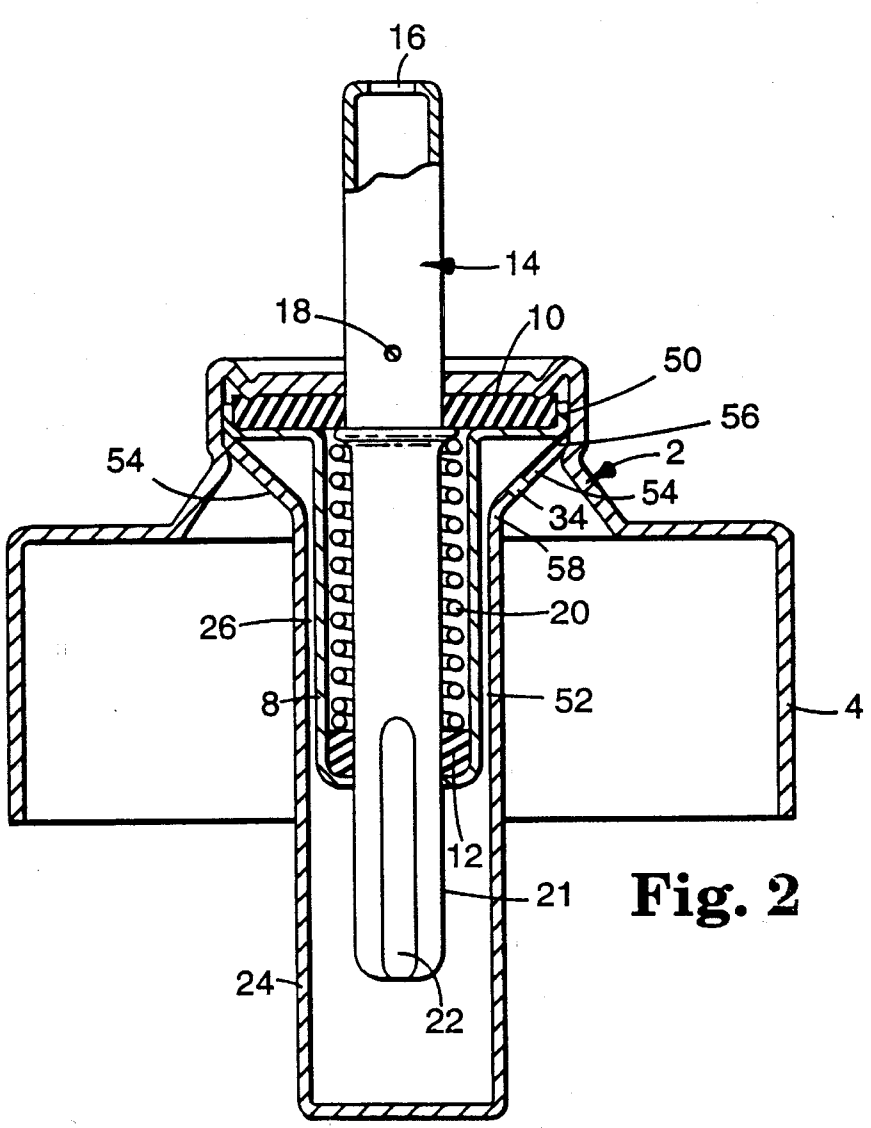
FIGS. 2 and 3 represent longitudinal sections through a dispensing valve of the type shown in FIG. 1 incorporating modifications in accordance with the invention.

The dosing uniformity of a valve of the type shown in FIG. 1 may be improved by a modification as shown in FIG. 2. The aperture (34) through which formulation passes to gain entry into the metering chamber has been reduced in diameter from 1 mm to 0.5 mm. In addition the aperture has been repositioned further away from the valve crimp. In this regard, as seen in FIG. 2, aperture (34) is located in inclined wall (54) at a position closer to second bend (58) than first bend (56). Both factors allow for more consistent dosing of product following a resting period when creaming of the formulation may have taken place.

Figure 3:
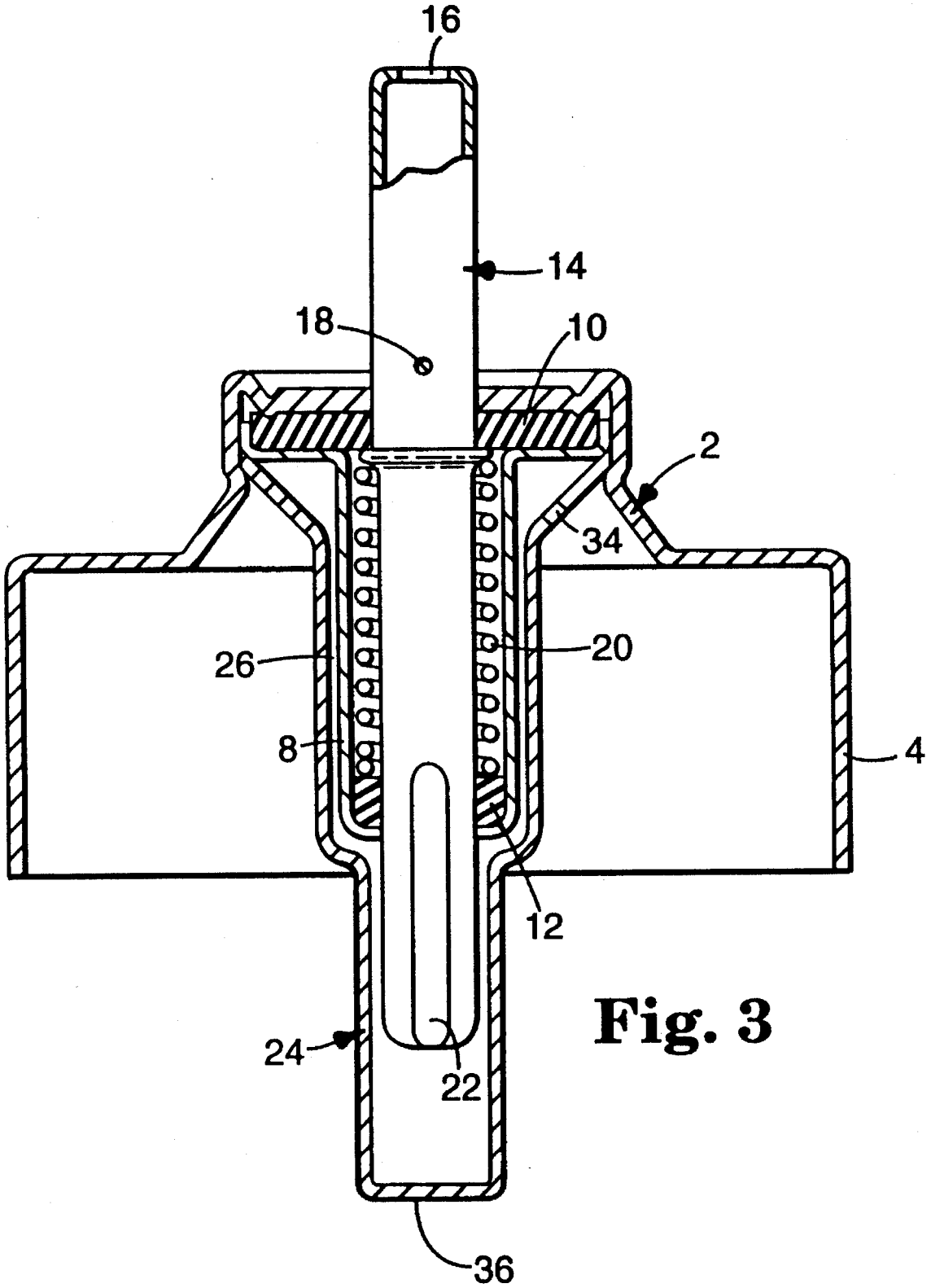

FIG. 3 shows a further modification in which the volume of the bottle emptier (24) is reduced by the end region (36) conforming closely to the valve stem (14). This design reduces the tendency for formulations to move in and out of the metering chamber (8) due to liquid expanding and contracting inside the bottle emptier (24) with changes in temperature.

Figure 4:
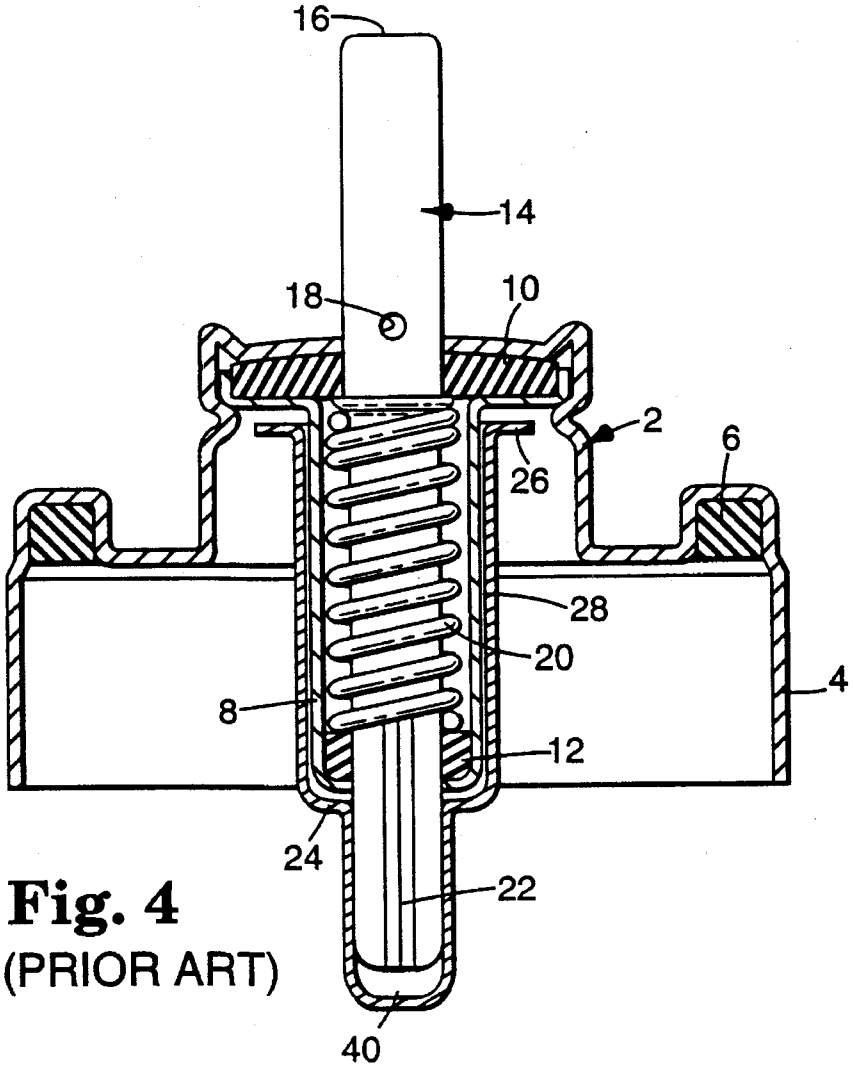
Fig. 4 (PRIOR ART)
FIG. 4 represents a longitudinal section through a second known dispensing valve.

Referring to FIG. 4, the known valve comprises a housing (2) having a flange (4) and annular seal (6). The neck of a dispensing container (not shown) is placed within the flange (4) against the seal (6) and the flange crimped around the neck to secure the valve to the dispensing container.

The valve comprises a metering chamber (8) having valve seals (10, 12) closing each end. A valve stem (14) extends through the seals (10, 12) and comprises a discharge end (16) in communication with a discharge orifice (18) which is positioned outside the metering chamber (8) when the valve stem is in its inoperative position but is moved within the metering chamber (8) when the valve stem (14) is depressed to its operative position to allow discharge of the contents of the metering chamber (8). The valve stem (14) is biased to its inoperative position by spring (20).

The valve stem defines a filling channel in the form of a groove (22.) which, when the valve stem is in its inoperative position, extends through the seal (12) to allow passage of contents into the metering chamber (8). As the valve stem (14) is moved to its operative position the groove (22) is moved out of the metering chamber (8) preventing passage of contents thereto.

The valve further comprises a bottle emptier (24) which is attached to the valve stem (14) and moves therewith. The bottle emptier (24) envelopes the end of the valve stem and metering chamber (8) and extends substantially the length of the metering chamber terminating in a circumferential flange (26). A capillary pathway in the form of an annular channel (28) is formed between the metering chamber (8) and bottle emptier (24) which allows passage of contents from the dispensing chamber to the metering chamber. As seen in FIG. 4, at the base of the bottle emptier (24), a closed void (40) is formed between the bottle emptier (24) and the bottom end of valve stem (14). As also seen in FIG. 4, in the rest position, groove (22) provides communication between metering chamber (8) and closed void (40). The bottle emptier allows substantially the entire contents of the dispensing container to be dispensed since it collects the contents from the bottom of the valve (the valve being inverted in use).

It has been found that the valve of FIG. 4 is prone to dosing inconsistencies when used with low concentration dispersion formulations having a propensity to cream, for example, formulations comprising an active ingredient suspended in an aerosol propellant where the concentration of the active ingredient is not more than 1 mg/g (1 milligram of active ingredient per gram of formulation).

Figure 5:
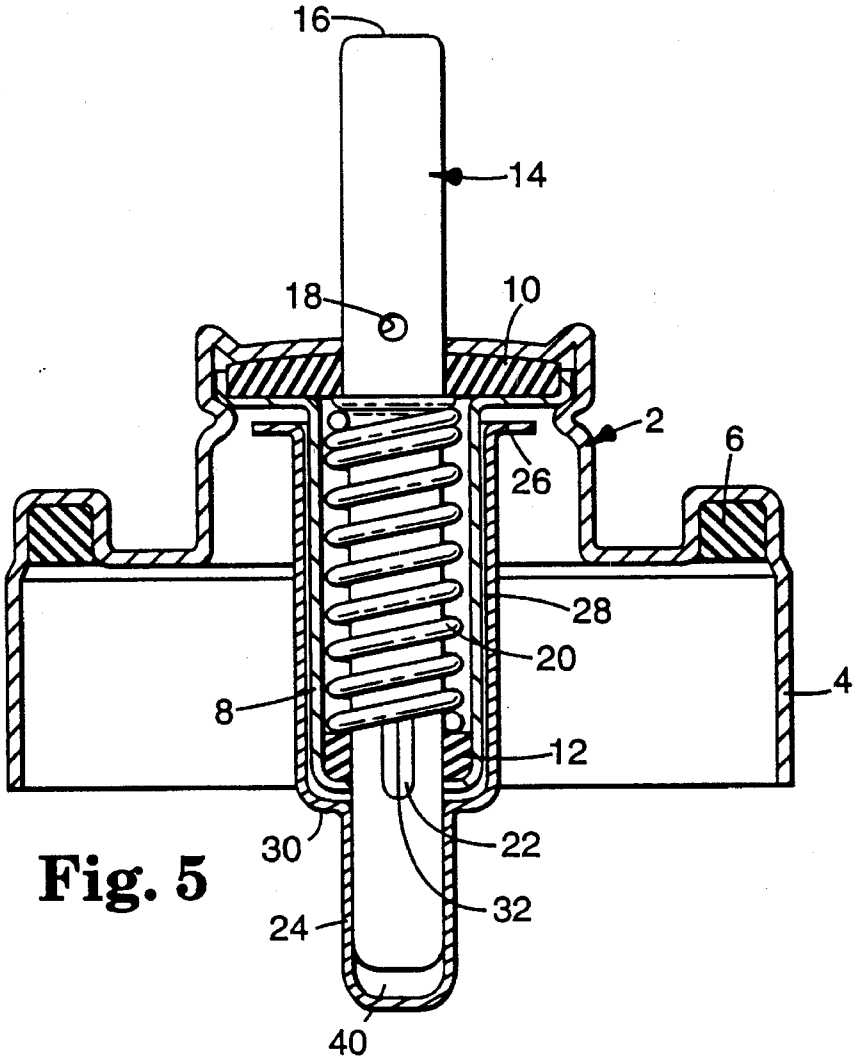
FIG. 5 represents a longitudinal section through a valve of the type shown in FIG. 4 incorporating a modification in accordance with the invention.

The valve shown in FIG. 5 is similar to that of FIG. 4 with the exception that the length of the stem groove (22) is reduced to the extent that when the valve is at rest, only the edge (32) of the stem groove protrudes from the metering tank, i.e., groove (22) does not extend to the very end of the bottom end of valve stem (14), thus providing for communication between annular channel (28) and groove (22) while preventing communication between groove (22) and the closed void (40) at the base of the tank. This arrangement substantially reduces axial cream out of contents of the metering chamber (8). The stem groove (22) can be further reduced in length such that the metering chamber is a closed volume when the valve is at rest. This design prevents material leaving or entering the metering tank during storage.

The flange (26) present in FIG. 5 may be removed. Removal of the flange eliminates the possibility of creaming of the contents between the flange and the metering tank. Also, a shorter bottle emptier (24) which extends no more than 90%, preferably less than 80%, more preferably about 70%, along the length of the metering chamber (8) may be employed. This arrangement further reduces the possibility of creaming of product between the bottle emptier (24) and metering chamber (8).

In a further embodiment, by elongating the bottle emptier the effect of creaming can be virtually reduced as can the possibility of excessive migration of active substance into the metering chamber. In such a design the bottle emptier flange and the metering tank flange may be in contact when the valve is in its inoperative position. In addition to flange-to-flange contact the bottle emptier (24) can also be profiled so that the shoulder (30) of the bottle emptier forms a contact with the inlet end of the metering tank when the valve stem is in its inoperative position thereby providing an additional barrier to migration of drug during storage.

A pathway for the contents can be provided by a radial channel formed by a debossing in the bottle emptier flange (26).

We claim:

1. A metered dose valve for dispensing a medicinal aerosol formulation from a pressurized container, comprising:

a valve ferrule having an aperture therethrough; a metering tank having walls defining an exterior, an internal metering chamber, an inlet orifice, an inlet end, and an outlet end; an elongate valve stem having a filling channel, a filling end, a discharge end, and a discharge orifice; and a tank retaining cup having a proximal end and a distal end;

wherein the outlet end of the metering tank is in sealing engagement with the valve ferrule, the discharge end of the valve stem passes through the valve ferrule aperture and the outlet end of the metering tank and is in slidable sealing engagement with the valve ferrule aperture;

wherein the filling end of the valve stem passes through and is in slidable engagement with the inlet orifice of the metering tank;

wherein the valve stem is movable between an inoperative position in which the filling channel of the valve stem allows open communication, via the inlet orifice, between the interior and the exterior of the metering chamber and the outlet end of the metering tank is closed, and an open position in which the inlet orifice of the metering tank is in sealing engagement with the filling end of the valve stem and the discharge orifice of the valve stem allows open communication between the interior and exterior of the metering chamber; and wherein the tank retaining cup has a first vertical wall which is more proximate to the discharge end of the valve stem than the fillinfi end thereof, a second vertical wall which is more proximate to the filling end of the valve stem than the discharge end thereof, and an inclined wall joining said first and second vertical walls at first and second bends, respectively, said tank retaining cup being attached at its proximal end to the valve ferrule, and said tank retaining cud surrounding the metering tank forming a capillary pathway from the proximal end of the tank retaining cup to the inlet end of the metering tank, which pathway is defined by the tank retaining cup and the exterior of the metering tank, wherein an aperture is formed in the inclined wall of the tank retaining cup , said aperture in the inclined wall being located closer to said second bend than said first bend and having a diameter of no more than about 0.5 mm.

2. A metered dose valve as claimed in claim 1 in which the tank retaining cup is shaped to closely follow the configuration of the end of the valve stem within the tank retaining cup.

3. A metered dose valve as claimed in claim 1 in which the aperture in said tank retaining cup has a diameter of about 0.5 mm.

4. A device comprising a pressurized aerosol container and a metered dose valve for dispensing aerosol formulation from said container, said valve comprising:

a valve ferrule having an aperture therethrough; a metering tank having walls defining an exterior, an internal metering chamber, an inlet orifice, an inlet end, and an outlet end; an elongate valve stem having a filling channel, a filing end, a discharge end, and a discharge orifice; and a tank retaining cup having a proximal end and a distal end;

wherein the outlet end of the metering tank is in sealing engagement with the valve ferrule, the discharge end of the valve stem passes through the valve ferrule aperture and the outlet end of the metering tank and is in slidable sealing engagement with the valve ferrule aperture;

wherein the filling end of the valve stem passes through and is in slidable engagement with the inlet orifice of the metering tank;

wherein the valve stem is movable between an inoperative position in which the filling channel of the valve stem allows open communication, via the inlet orifice, between the interior and the exterior of the metering chamber and the outlet end of the metering tank is closed, and an open position in which the inlet orifice of the metering tank is in sealing engagement with the filling end of the valve stem and the dischame orifice of the valve stem allows open communication between the interior and exterior of the meterinq chamber; and wherein the tank retaining cup has a first vertical wall which is more proximate to the discharge end of the valve stem than the filling end thereof, a second vertical wall which is more proximate to the filling end of the valve stem than the discharge end thereof, and an inclined wall ioininfi said first and second vertical walls at first and second bends, respectively, said tank retaining cup being attached at its proximal end to the valve ferrule, and, said tank retaining cup surrounding the metering tank forming a capillary pathway from the proximal end of the tank retaining cup to the inlet end of the metering tank, which pathway is defined by the tank retaining cup and the exterior of the motoring tank, wherein an aperture is formed in the inclined wall of the tank retaining cup, said aperture in the inclined wall being located closer to said second bend than said first bend and having a diameter of no more than about 0.5 mm.

5. A device as claimed in claim 4 containing a formulation comprising an active ingredient suspended in aerosol propellant, the concentration of active ingredient being not more than 1 mg/g.

6. A metered dose valve for dispensing a medicinal aerosol formulation from a pressurized container, comprising:

a valve ferrule having an aperture therethrough; a metering tank having walls defining an exterior, an internal metering chamber, an inlet orifice, an inlet end, and an outlet end; an elongate valve stem having a filling channel which extends only part way along the valve stem, a filling end, a discharge end, and a discharge orifice, said valve stem being configured such that said filling channel does not extend to the very end of the discharge end; and a bottle emptier having a proximal end and a distal end;

wherein the outlet end of the metering tank is in sealing engagement with the valve ferrule, the discharge end of the valve stem passes through the valve ferrule aperture and the outlet end of the metering tank and is in slidable sealing engagement with the valve ferrule aperture;

wherein the filling end of the valve stem passes through and is in slidable engagement with the inlet orifice of the motoring tank;

wherein the bottle emptier is attached at its distal end to the filling end of the valve stem so as to form a closed void therebetween and wherein the bottle emptier surrounds at least the inlet end of the metering tank forming a capillary pathway from the proximal end of the bottle emptier to the inlet end of the metering tank, which pathway is defined by the bottle emptier and the exterior of the metering tank; and wherein the valve stem is movable between (a) an inoperative position in which the outlet end of the metering tank is closed and in which the filling channel of said valve stem extends slightly from the metering chamber such that there is open communication between the metering chamber and the capillary pathway but no communication between the metering chamber and the closed void, the configuration and position of the filling channel thus being effective to reduce cream-out during rest and (b) an open position in which the inlet orifice of the metering tank is in sealing engagement with the filling end of the valve stem and the discharge orifice of the valve stem allows open communication between the interior and exterior of the metering chamber.

7. A device comprising a pressurized aerosol container and a metered dose valve for dispensing aerosol formulation from said container, said valve comprising:

a valve ferrule having an aperture therethrough; a metering tank having walls defining an exterior, an internal metering chamber, an inlet orifice, an inlet end, and an outlet end; an elongate valve stem having a filling channel which extends only part way along the valve stem, a filling end, a discharge end, and a discharge orifice, said valve stem being configured such that said filling channel does not extend to the very end of the discharge end; and a bottle emptier having a proximal end and a distal end;

wherein the outlet end of the meterinfi tank is in sealing engagement with the valve ferrule, the discharge end of the valve stem passes through the valve ferrule aperture and the outlet end of the metering tank and is in slidable sealing engagement with the valve ferrule aperture;

wherein the filling end of the valve stem passes through and is in slidable engagement with the inlet orifice of the metering tank;

wherein the bottle emptier is attached at its distal end to the filling end of the valve stem so as to form a closed void therebetween and wherein the bottle emptier surrounds at least the inlet end of the metering tank forming a capillary pathway from the proximal end of the bottle emptier to the inlet end of the metering tank, which pathway is defined by the bottle emptier and the exterior of the metering tank; and wherein the valve stem is movable between (a) an inoperative position in which the outlet end of the metering tank is closed and in which the filling channel of said valve stem extends slightly from the metering chamber such that there is open communication between the metering chamber and the capillary pathway but no commupication between the metering chamber and the closed void, the configuration and position of the filling channel thus being effective to reduce cream-out during rest and (b) an open position in which the inlet orifice of the metering tank is in sealing engagement with the filling end of the valve stem and the discharge orifice of the valve stem allows open communication between the interior and exterior of the metering chamber.

8. A device as claimed in claim 7 containing a formulation comprising an active ingredient suspended in aerosol propellant, the concentration of active ingredient being not more than 1 mg/g.

* * * * *

UNITED STATES PATENT AND TRADEMARK OFFICE

CERTIFICATE OF CORRECTION

PATENT NO. : 5,477,992

DATED : December 26, 1995

INVENTOR(S) : Philip A. Jinks et al.

It is certified that error appears in the above-indentified patent and that said Letters Patent is hereby corrected as shown below:

On the cover page, [75] Inventors, line 3, "Burnely" should be --Burnley--.
Col. 4, line 26, "filing" should be --filling--.
Col. 5, line 2, "(22.)" should be --(22)--.
Col. 6, line 35, claim 1, line 31, "fillinfi" should be --filling--.
Col. 6, line 41, claim 1, line 37, "cud" should be --cup--.
Col. 6, line 47, claim 1, line 43, "cup ," should be --cup,--.
Col. 6, line 65, claim 4, line 8, "filing" should be --filling--.
Col. 7, line 16, claim 4, line 26, "dischame" should be --discharge--.
Col. 7, line 18, claim 4, line 28, "meterinq" should be --metering--.
Col. 7, line 24, claim 4, line 34, "ioininfi" should be --joining--.
Col. 7, line 27, claim 4, line 37, "and," should be --and--.
Col. 7, line 31, claim 4, line 41, "motoring" should be --metering--.
Col. 7, line 61, claim 6, line 21, "motoring" should be --metering--.
Col. 8, line 31, claim 7, line 14, "meterinfi" should be --metering--.
Col. 8, line 53, claim 7, line 36, "commupication" should be --communication--.

Signed and Sealed this

Twenty-eighth Day of May, 1996

*Attest:*

BRUCE LEHMAN

*Attesting Officer*

*Commissioner of Patents and Trademarks*